US008298967B2

(12) United States Patent
Egan et al.

(10) Patent No.: US 8,298,967 B2
(45) Date of Patent: Oct. 30, 2012

(54) EXTERIOR FINISHING SYSTEM AND BUILDING WALL CONTAINING A CORROSION-RESISTANT ENHANCED THICKNESS FABRIC

(75) Inventors: William F. Egan, Ponte Vedra Beach, FL (US); Mark Newton, Perkinsfield (CA); Mark W. Tucker, Waubaushene (CA)

(73) Assignee: BASF Corporation, Florham Park, NJ (US)

( * ) Notice: Subject to any disclaimer, the term of this patent is extended or adjusted under 35 U.S.C. 154(b) by 0 days.

(21) Appl. No.: 13/011,599

(22) Filed: Jan. 21, 2011

(65) Prior Publication Data

US 2011/0143616 A1 Jun. 16, 2011

Related U.S. Application Data

(63) Continuation of application No. 12/475,652, filed on Jun. 1, 2009, now Pat. No. 7,902,092, which is a continuation of application No. 10/740,774, filed on Dec. 19, 2003, now Pat. No. 7,625,827.

(51) Int. Cl.

| | |
|---|---|
| ***B32B 13/14*** | (2006.01) |
| ***D04H 1/00*** | (2006.01) |
| ***B32B 27/04*** | (2006.01) |
| ***D03D 9/00*** | (2006.01) |
| ***D03D 13/00*** | (2006.01) |
| ***D03D 15/00*** | (2006.01) |
| ***E04B 2/00*** | (2006.01) |

(52) U.S. Cl. ..... 442/42; 442/2; 442/20; 442/43; 442/203; 442/205; 428/292.4; 428/294.7; 52/506.01

(58) Field of Classification Search ..... 442/20, 442/42–46, 74; 428/292.4, 294.7
See application file for complete search history.

(56) References Cited

U.S. PATENT DOCUMENTS

| | | | |
|---|---|---|---|
| 2,030,668 | A | 2/1936 | Weyerhaeuser et al. |
| 2,324,916 | A | 7/1943 | Duncan et al. |
| 2,541,762 | A | 2/1951 | Heritage |
| 2,897,109 | A | 7/1959 | Voigtman |
| 3,044,919 | A | 7/1962 | Stoneburner |
| 3,095,338 | A | 6/1963 | Romanin |

(Continued)

FOREIGN PATENT DOCUMENTS

| | | |
|---|---|---|
| DE | 1081205 | 5/1960 |

(Continued)

OTHER PUBLICATIONS

Fabric Reference, Mary Humphries, Prentice Hall, copyright 1996.*

(Continued)

*Primary Examiner* — Jennifer A Steele
(74) *Attorney, Agent, or Firm* — Curatolo Sidoti Co., LPA; Salvatore A. Sidoti; Julie D. Hawk

(57) ABSTRACT

A corrosion-resistant lath is provided for use in exterior finishing systems, such as stucco systems and exterior insulation and finish systems ("EIFS"). The lath includes in a first embodiment an open, woven fabric comprising weft and warp yarns containing non-metallic fibers, such as glass fibers. A portion of the weft yarns are undulated, resulting in an increased thickness for the fabric. The fabric is coated with a polymeric resin for substantially binding the weft yarns in the undulated condition. This invention also includes methods for making an exterior finish system and building wall including an exterior finish system using such a lath.

18 Claims, 4 Drawing Sheets

U.S. PATENT DOCUMENTS 3,135,069 A 6/1964 Schuller et al.
3,204,379 A 9/1965 Osborn
3,284,980 A 11/1966 Dinkel
3,754,362 A 8/1973 Daimler et al.
4,015,302 A 4/1977 Clark
4,019,326 A 4/1977 Herveling et al.
4,024,719 A 5/1977 Risseeuw
4,062,160 A 12/1977 Christison
4,087,191 A 5/1978 Brady et al.
4,107,372 A 8/1978 Clausen et al.
4,111,582 A 9/1978 Tippett
4,253,288 A 3/1981 Chun
4,298,413 A 11/1981 Teare
4,315,392 A 2/1982 Sylvest
4,329,392 A 5/1982 Bronner
4,351,867 A 9/1982 Mulvey et al.
4,450,022 A 5/1984 Galer
4,472,086 A 9/1984 Leach
4,488,909 A 12/1984 Galer et al.
4,518,652 A 5/1985 Willoughby
4,578,915 A 4/1986 Schneller
4,668,547 A 5/1987 Brouessard
4,669,246 A 6/1987 Freeman
4,689,258 A 8/1987 Slosberg et al.
4,699,542 A 10/1987 Shoesmith
4,805,367 A 2/1989 Kleckner
4,810,569 A 3/1989 Lehnert et al.
4,810,573 A 3/1989 Harriett
4,815,963 A 3/1989 Berkhout
4,840,515 A 6/1989 Freese
4,851,277 A 7/1989 Valkenburg et al.
4,876,151 A 10/1989 Eichen
4,916,004 A 4/1990 Ensminger et al.
4,942,699 A 7/1990 Spinelli
4,943,185 A 7/1990 McGuckin et al.
4,946,310 A 8/1990 Wunderatzke
4,957,390 A 9/1990 Shoesmith
5,019,195 A 5/1991 Skinner
5,030,502 A 7/1991 Teare
5,081,814 A 1/1992 Singletary et al.
5,099,627 A 3/1992 Coulton et al.
5,110,627 A 5/1992 Shoesmith et al.
5,110,656 A * 5/1992 Inaba et al. ..... 442/5
5,143,757 A 9/1992 Skinner
5,218,798 A 6/1993 Bentivegna et al.
5,230,189 A 7/1993 Sourlis
5,230,192 A 7/1993 Webb et al.
5,238,450 A 8/1993 Rotter
5,244,693 A 9/1993 Inaba et al.
5,246,306 A 9/1993 Shoesmith et al.
5,287,673 A 2/1994 Kreikemeier
5,308,692 A 5/1994 Kennedy et al.
5,371,989 A 12/1994 Lehnert et al.
5,393,559 A 2/1995 Shoesmith et al.
5,410,852 A 5/1995 Edgar et al.
5,456,785 A 10/1995 Venable
5,476,340 A 12/1995 Contrasto
5,481,843 A 1/1996 Kreikemeier
5,545,441 A 8/1996 Land
5,573,844 A 11/1996 Donovan et al.
5,598,673 A 2/1997 Atkins
5,697,195 A 12/1997 Maylon
5,704,179 A 1/1998 Lehnert et al.
5,732,520 A 3/1998 Maietta
5,771,649 A 6/1998 Zweig
5,826,388 A 10/1998 Irving
5,836,715 A 11/1998 Hendrix et al.
5,960,595 A 10/1999 McCorsley, III et al.
5,965,467 A * 10/1999 Stevenson et al. ..... 442/218
6,054,205 A 4/2000 Newman et al.
6,131,353 A 10/2000 Egan
6,192,650 B1 2/2001 Kittson et al.
6,235,136 B1 5/2001 Kittson et al.
6,296,912 B1 10/2001 Zickell
6,355,333 B1 * 3/2002 Waggoner et al. ..... 428/174
6,360,780 B1 3/2002 Adolphs et al.
6,615,875 B2 9/2003 Adolphs et al.
6,666,618 B1 12/2003 Anaya et al.
6,838,163 B2 1/2005 Smith et al.
7,049,251 B2 5/2006 Porter
7,204,065 B2 4/2007 Naji
7,232,276 B2 6/2007 Oka et al.
7,279,436 B2 10/2007 Pintz
7,354,876 B2 * 4/2008 Porter et al. ..... 442/172
7,632,763 B2 12/2009 Newton et al.
2004/0152379 A1 8/2004 McLarty, III et al.

FOREIGN PATENT DOCUMENTS

DE 4137310 5/1993
DE 4311357 10/1994
DE 4431976 3/1995
DE 19962441 7/2005
EP 526848 2/1993
EP 0 957 203 A2 11/1999
EP 1 239 080 A1 9/2002
GB 1 447 775 9/1976
GB 2 053 779 A 2/1981
GB 2 119 703 A 11/1983
JP 03-254928 11/1991
JP 5-009902 1/1993
JP 5-33522 8/1993
JP 06-185181 9/1993
JP 9-177014 7/1997
JP 11-323812 11/1999
JP 2002-88614 3/2002
NL 7707355 1/1979
WO WO 89/04897 6/1989
WO WO 99/14442 3/1999
WO WO 99/29978 6/1999
WO WO 00/37726 6/2000
WO WO 01/44579 6/2001

OTHER PUBLICATIONS

AMICO, *Metel Lath and Accessories*, Product Description.
Dryvit, *Dryvit Drainage Mat* (*DS446*), http://www.dryvit.com/files/Dryvit_docs/us/description/ds446.htm; Jan. 2, 2003.
Eternit, Trade literature, 2 pages.
Eternit Trade literature, Architectural Roofing Slates, Fiber Reinforced Cement Shingles, pp. 1-4, 1989.
Eternit Trade literature, Eternit Slates, 1989, pp. 1-7.
Eternit Trade literature, Qatra Exterior Wall System, 1989, pp. 1-4.
Eternit Trade literature, Eterspan®, a Fiber Reinforced Cement Panel, 1988, pp. 1-8.
Eternit Trade literature, Glasweld, Architectural Building Panel, 1989, pp. 1-8.
Eternit Trade literature, Eterboard®, High Performance, Asbestos Free, Fiber Reinforced Cement Panel, 1988, pp. 1-4.
Eternit Trade literature, Eflex®, High Performance, Asbestos Free, Fiber Reinforced Cement Panel, 1988, pp. 1-4.
Eternit Trade literature, Profile 3, 3 inch Corrugated Lightweight Fiber Reinforced Cement Sheets, pp. 1-2.
Eternit Trade literature, Profile 4.2, 4.2 inch Corrugated Fiber Reinforced Cement Sheets, 1990, pp. 1-2.
Eternit Trade literature, Profile 6, Corrugated Roofing and Siding, 1989, pp. 1-4.
Eternit Trade literature, Facad, Sculptured Architectural Panels, Jan. 1989, pp. 1-4.
Eternit Trade literature, Substrate "500", Ceramic Tile Backer Board, 1989, pp. 1-6.
Eternit Trade literature, Substrate "500", Cement Backer Board for Ceramic Tile—Lifetime Performance, 1990, pp. 1-6.
Eternit Trade literature, Worldwide Manufacturing, pp. 1-2.
"Fiberlath Product Detail." Modern Materials, Inc., ., http://www.fiberlath.com/index.htm and http://www.fiberlath.com/index_files/Page583.htm.
Georgia Lathing & Plasteric Contractors Association, *EIFS*, http://www.glpca/com/technical.htm; Jan. 2, 2003.
ICBO Evaluation Service, Inc., *Acceptance Criteria for Cementitious Exterior Wall Coatings*, No. AC11, Sep. 2002.
ICBO Evaluation Service, Inc., *Evaluation Report*, No. ER-2728, Oct. 1, 2000.

ICBO Evaluation Service, Inc., *Evaluation Report*, No. ER-4368, Sep. 1, 2000.
ICBO Evaluation Service, Inc., *ES Report*, No. ER-5987, Feb. 1, 2002.
ICC Evaluation Service, Inc., *Legacy Report*, No. NER-676, Jul. 1, 2003.
Johns Manville, *AP Foil-Faced Polyisocyanurate Foam Sheathing*, Product Description, 2002.
Kettenwirkpraxis, trade literature, Mar. 1993, pp. 1-8, translated from German.
Kettenwirkpraxis, trade literature, Jan. 1989, pp. 1-9, translated from German.
Pillar To Post, *Synthetic Stucco—EIFS*, No. 21A, 1999.
Remodelers Council, "Building Permit will Specify Materials, Methods", *Albuquerque Journal*, Oct. 20, 2002.
Saint-Gobain Vetrotex Twintex Overview, 1 page, 2001.
Saint-Gobain Vetrotex Twintex Material Properties, 3 page, 2001.
Saint-Gobain Vetrotex Twintex Material Safety Data Sheet, 15 pages, 2003.
Saint-Gobain Vetrotex Twintex Glass/R PP Roving, 2 pages, 2001.
Saint-Gobain Vetrotex Twintex Glass/P PP Plates, 2 pages, 2001.
Sanjon Corp., *Stucco Solutions*, http://www.sanjon.com/stuccosolutions.htm; Jan. 2, 2003.
Sto Corp., *Sto RainScreen II, Short Form Specification A 800*, Section 07240, Google's Cache of http://www.stocorp.com/othersections.nsf/htmlmedia/A800SF.htm; Jan. 2, 2003.
Warren et al., Decision on Appeal No. 2003-1901, Mar. 9, 2004, pp. 1-10. U.S. Patent and Trademark Office.
Webber, Ron, *Top Quality Three-Coat Stucco*, Google's Cache of http://www.slcc.edu/tech/techsp/arch/courses/ARCH1210/Lecture/Siding/Stucco; Jan. 2, 2003.
English language abstract of JP 03-254928; Publication Date Nov. 13, 1991; Applicant: Kanebo Ltd.
English translation of Communication from the Japanese Patent Office mailed Feb. 22, 2010 for the counterpart Japanese patent application to U.S. Appl. No. 12/475,652.

* cited by examiner

EXTERIOR FINISHING SYSTEM AND BUILDING WALL CONTAINING A CORROSION-RESISTANT ENHANCED THICKNESS FABRIC

CROSS REFERENCE TO RELATED APPLICATIONS

This application is a continuation of U.S. Ser. No. 12/475,652, filed on Jun. 1, 2009, which is a continuation application of U.S. patent application Ser. No. 10/740,774 filed on Dec. 19, 2003, now U.S. Pat. No. 7,625,827, both of which are hereby incorporated by reference.

BACKGROUND

The present invention relates to exterior insulation and finish systems and building walls including an enhanced thickness fabric that is useful in reinforcing a matrix of exterior finishing materials, and especially, to a corrosion resistant lath for supporting exterior finishing materials, such as stucco.

Hard coat stucco has been in use since ancient time, while synthetic stuccos and exterior insulation and finishing systems ("EIFS") have been used on construction in North America and Europe since World War II. The most common EIFS is formed around a polystyrene board which is adhered or fastened to a substrate, such as oriented strand board ("OSB") gypsum or plywood sheathing. The polystyrene board is then coated with a "base coat" layer of at least 1/16 inch in thickness which contains cement mixed with an acrylic polymer. The base coat is generally layered with an embedded glass fiber reinforced mesh which helps to reinforce it against cracking. A "finish coat", typically at least 1/16 inch or more in thickness, is either sprayed, troweled, or rolled onto the base coat. The finish coat typically provides the color and texture for the structure.

For stucco applications, the lath or wire mesh is typically applied to the surface of the polystyrene board, or any other surface that would otherwise not provide adequate mechanical keying for the stucco. Metal-lath reinforcement is often used whenever stucco is applied over open frame construction, sheathed frame construction, or a solid base having a surface that provides an unsatisfactory bond. When applied over frame construction, the two base coats of plaster should have a total thickness of approximately 3/8 to approximately 3/4 inches (19 mm) to produce a solid base for the decorative finish coat.

Metal lath reinforcement is also recommended for the application of stucco and plaster to old concrete or masonry walls, especially if the surface has been contaminated, or is lacking in compatibility with the base layer. There are also plastic laths available for the same purpose.

According to the International Conference of Building Officials Acceptance Criteria for Cementitious Exterior Wall Coatings, AC 11, effective Oct. 1, 2002, and evaluation report NER-676, issued Jul. 1, 2003, wire fabric lath should be a minimum of No. 20 gauge, 1 inch (25.4 mm) (spacing) galvanized steel woven-wire fabric. The lath must be self-furred, or furred when applied over all substrates except unbacked polystyrene board. Self-furring lath for coatings must comply with the following requirements: (1) the maximum total coating thickness of 1/2 inch (25.4-50.8 mm); (2) furring crimps must be provided at maximum 6 inch intervals each way; and (3) the crimps must fur the body of the lath a minimum of 1/8 inch (3.18 mm) from the substrate after installation. In addition to the NER-676 code, lath for stucco systems typically must be at least 0.125 inches thick in order to meet the building codes for metal lath (ASTM C847-95), for welded wire lath (ASTM C933-96A), and for woven wire plaster base (ASTM C1032-96).

While galvanized metal lath can substantially prevent stucco from sloughing or sagging until it has set, it contains steel which can eventually rust and cause discoloration in the finish coat. In fact, one drawback of metal lath for use in stucco in shore communities is that salt water and driving rain accelerate the corrosion of steel components. Another drawback to wire lath is that cutting and furring often exposes sharp metal wire which can penetrate the skin or a glove of a construction worker.

Accordingly, there remains a need for an improved lath for stucco systems which is corrosion resistant and easier to install with a minimal risk of injury.

SUMMARY

An exterior finish system, such as a stucco system or an exterior insulation and finish system, which includes an enhanced thickness fabric for reinforcing or supporting a matrix of exterior finishing materials. The enhanced thickness fabric may in the form of an enhanced thickness lath for use in a stucco system or an enhanced thickness reinforcing mesh for exterior insulation and finish systems.

In a first embodiment, an exterior finishing system including a corrosion-resistant lath is provided. The lath includes a porous layer containing non-metallic fibers; and a polymeric coating disposed over at least a portion of the fibers. The polymeric coated porous layer has a thickness of at least about 0.125 inches (3.18 mm) and is capable of retaining and supporting the weight of exterior finishing materials, for example, wet stucco matrix or EIFS base coats applied thereto, without sloughing or sagging.

The corrosion-resistant lath structures eliminate rusting and subsequent discoloration problems inherent in steel mesh or steel lath installations. These structures are also much easier to cut and install than steel lath and minimize the risk of damage to the skin of workers. Another advantage of the lath of non-metallic fibers resides in the fact that the ease of cutting and manipulation of the lath results in a much quicker installation, as compared to traditional metal lath and wire mesh. These lath structures have thicknesses which are sufficient to meet minimum building codes, yet they are made in a cost-effective way so as to render them competitive with steel lath.

In a preferred embodiment, an exterior finishing system is provided, which includes a lath comprising an open-woven fabric comprising high-strength non-metallic weft and warp yarns, whereby a portion of the yarns are mechanically manipulated to increase the fabric's thickness by at least about 50%, and preferably, greater than about 100%. The lath of this embodiment is capable of retaining and supporting the weight of exterior finishing materials, such as, for example, wet stucco applied to its surface until the stucco sets.

In further embodiments of this invention, a leno weave fabric consisting of warp (machine direction yarns), twisted around well yarns (cross-machine direction yarns) is provided. The well yarns are preferably inserted through the twisted warp yarns at regular intervals and are mechanically locked in place. When tension is applied to the warp yarns they are inclined to untwist themselves, thus creating a torque effect on the well yarns. As each warp yarn untwists due to this torque effect, each weft yarn assumes a sinusoidal pattern when viewed in the plane of the fabric, or the front plan view of FIG. 3. The thickness of the fabric thus increases, with only a small loss in the width of the fabric. Such a "thickening" effect can also be produced with an "unbalanced" fabric construction, such as when the combined weight of the warp yarns is greater than the combined weight of the weft yarns, so the ability of the well yarns to resist deformation due to torque under normal manufacturing conditions is reduced. Another way to accomplish thickening is to use heavier warp yarn, and less of them in the warp direction. This creates greater tension per warp yard and a wider span of weft yarn for the tensile force to act upon. The result is an increased torque effect, also under normal manufacturing conditions, with an accompanying increase in fabric thickness. The use of both tension and unbalanced fabric constructions at the same time is also useful.

The yarns or fibers of the open-woven fabric component of the exterior finishing systems are coated to hold them in a fixed or bound position. The resinous coatings selected by this invention are preferably rigid and resist softening by, or dissolving in, exterior finishing materials, such as wet stuccos and EIFS base and finish coats. Suitable polymers for the resinous coating include styrene/butadiene and styrene/acrylic polymers of high styrene content or any alkali resistant polymer of similar high stiffness. The type of fiberglass selected is also important when glass fibers are used. The glass itself can be selected to resist degradation in alkaline environments. For example, when the lath is used in a stucco system including stucco manufactured from higher Portland cement content, alkali resistant or "AR" glass is a suitable choice.

BRIEF DESCRIPTION OF THE DRAWINGS

The accompanying drawings illustrate preferred embodiments of the invention, as well as other information pertinent to the disclosure, in which.

DETAILED DESCRIPTION

Figure 1:
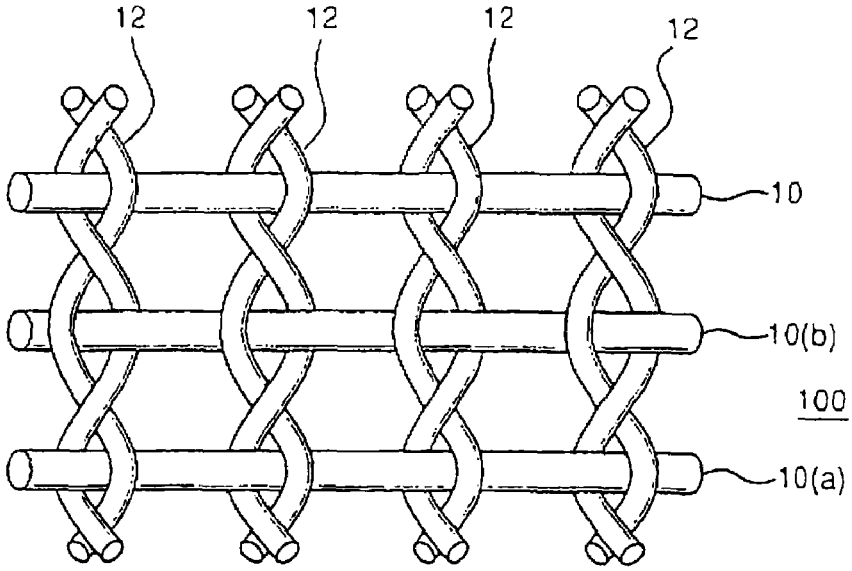
FIG. 1 is a top plan view of a corrosion-resistant fabric structure of this invention prior to fiber manipulation.

Exterior finishing systems including corrosion-resistant lath structures are provided. Exterior finishing systems generally include a non-load bearing wall, an optional insulation board, an optional weather barrier, followed by a textured protective finish coat. The exterior finishing system may comprise an exterior insulation and finish system (EIFS) or a stucco system. In general, EIFS includes a non-load bearing wall, optionally a weather barrier attached to the wall, an insulation board that is adhesively or mechanically attached to the wall, a base coat applied to the face of the insulation board, a reinforcing mesh substantially embedded within the base coat and a finish coat. Stucco systems typically include a non-load bearing wall, optionally a weather barrier attached to the wall, optionally an insulation board attached to the wall, a lath attached to the wall or to the face of the insulation board, and at least one layer of stucco. The layer of stucco may also include a finish coating.

In one embodiment, the lath component of the exterior finishing systems is directed to replacing metal lath or wire mesh where stucco or plaster is applied to a polystyrene board, OSB, plywood or gypsum board substrate, open wood frame or sheathed frame construction, stonewalls, or other surfaces that, in and of themselves, do not provide adequate mechanic keying for the plaster or stucco. The laths are useful in "one coat stucco" systems in which a blend of Portland cement, sand, fibers and special chemicals are employed to produce a durable, cost effective exterior wall treatment. One coat stucco systems combine "scratch and brown" coats into a single application of about ⅜ inches (9.53 mm) thick or more, and are typically applied by hand-trowling or machine spraying onto almost any substrate, such as foam, plastic sheathing, insulation foam, exterior gypsum, asphalt impregnated sheathing, plywood or temporal OSB exterior sheathing.

The lath can also be used in traditional stucco systems, also known as hard coat, thick coat, cement stucco or polymer modified stucco, in which the system consists of a substrate, such as plywood sheathing, OSB or gypsum board, an optional rigid foam insulation board, such as polystyrene, adhered or fastened to the substrate, up to about ¾ inches (19.05 mm) of thickness of a base coat, primarily including cement mixed with acrylic polymer, and a finish coat either sprayed, trowled or rolled onto the base coat, which provides color and texture. The lath structures of this invention are designed to replace the metal lath or mesh, which is usually stapled, nailed or screwed to the substrate, or through the optional insulation board, prior to the application of the base coat or one coat stucco application.

Defined Terms

Cementitious material. An inorganic hydraulically setting material, such as those containing one or more of: Portland cement, mortar, plaster, gypsum, and/or other ingredients, such as, foaming agents, aggregate, resinous additives, glass fibers, moisture repellants and moisture resistant additives and fire retardants.

Composite facing material. Two or more layers of the same or different materials including two or more layers of fabrics, cloth, knits, mats, wovens, non-wovens and/or scrims, for example.

Fabric. Woven or non-woven flexible materials, such as tissues, cloths, knits, weaves, carded tissue, spun-bonded and point-bonded non-wovens, needled or braided materials.

Fiber. A general term used to refer to filamentary materials. Often, fiber is used synonymously with filament. It is generally accepted that a filament routinely has a finite length that is at least 100 times its diameter. In most cases, it is prepared by drawing from a molten bath, spinning, or by deposition on a substrate.

Filament. The smallest unit of a fibrous material. The basic units formed during drawing and spinning, which are gathered into strands of fiber for use in composites. Filaments usually are of extreme length and very small diameter. Some textile filaments can function as a yarn when they are of sufficient strength and flexibility.

Glass. An inorganic product of fusion that has cooled to a rigid condition without crystallizing. Glass is typically hard and relatively brittle, and has a conchoidal fracture.

Glass cloth. An oriented fabric which can be woven, knitted, needled, or braided glass fiber material, for example.

Glass fiber. A fiber spun from an inorganic product of fusion that has cooled to a rigid condition without crystallizing.

Glass Filament. A form of glass that has been drawn to a small diameter and long lengths.

Knitted fabrics. Fabrics produced by interlooping chains of filaments, roving or yarn.

Mat. A fibrous material consisting of randomly oriented chopped filaments, short fibers, or swirled filaments loosely held together with a binder.

Roving. A number of yarns, strands, tows, or ends collected into a parallel bundle with little or no twist.

Stucco. A mixture of sand, cementitious material, water, optionally lime, and optionally other additives and/or admixtures. It can be applied over a reinforcing medium or any suitable rigid base, for example, sheathing or an insulation board, and is sometimes referred to as "hardcoat or conventional stucco" application; such as a scratch (first) coat, brown (second) coat, then a finish coat (usually a factory mix) with color added, or "one coat" which is a blend of cementitious material, sand, fibers and special chemicals, such as acrylic, which produce a durable, cost effective exterior.

Tensile strength. The maximum load or force per unit cross-sectional area, within the gage length, of the specimen. The pulling stress required to break a given specimen. (See ASTM D579 and D3039)

Tex. Linear density (or gauge) of a fiber expressed in grams per 1000 meters.

Textile fibers. Fibers or filaments that can be processed into yarn or made into a fabric by interlacing in a variety of methods, including weaving, knitting and braiding.

Warp. The yarn, fiber or roving running lengthwise in a woven fabric. A group of yarns, fibers or roving in long lengths and approximately parallel.

Weave. The particular manner in which a fabric is formed by interlacing yarns, fibers or roving. Usually assigned a style number.

Weft. The transverse threads or fibers in a woven fabric. Those fibers running perpendicular to the warp. Also called fill, filling yarn or woof.

Woven fabric. A material (usually a planar structure) constructed by interlacing yarns, fibers, roving or filaments, to form such fabric patterns, such as plain, harness satin, or leno weaves.

Woven roving. A heavy glass fiber fabric made by weaving roving or yarn bundles.

Yarn. An assemblage of twisted filaments, fibers, or strands, either natural or manufactured, to form a continuous length that is suitable for use in weaving or interweaving into textile materials.

Zero-twist-yarn. A lightweight roving, i.e., a strand of near zero twist with linear densities and filament diameters typical of fiberglass yarn (but substantially without twist).

With reference to the Figures, and particularly to FIGS. 1-6 thereof, there is depicted a fabric 101 useful as a matrix reinforcement, generally, and more specifically, as a replacement for metal lath or wire mesh, such as woven wire galvanized lath or galvanized expanded metal lath, or substantially planar glass reinforcing mesh used in exterior finishing systems, such as EIFS, DEFS (direct exterior finishing systems, i.e.,—without insulation), and stucco systems. Needled, woven, knitted and composite materials are preferred because of their impressive strength-to-weight ratio and, in the case of wovens and knits, their ability to form well and warp yarn patterns which can be manipulated into the lath structures of this invention. The fabric 101 and lath 30 of this invention can contain fibers and filaments of organic and inorganic materials, such as glass, olefin (such as polyethylene, polystyrene and polypropylene), Kevlar®, graphite, rayon, polyester, carbon, ceramic fibers, or combinations thereof, such as glass-polyester blends or Twintex® glass-olefin composite, available from Companie de Saint Gobain, France. Of these types of fibers and filaments, glass compositions are the most desirable for their fire resistance, low cost and high mechanical strength properties.

Glass Composition

Although a number of glass compositions have been developed, only a few are used commercially to create continuous glass fibers. The four main glasses used are high alkali (AR-glass) useful in the case of higher Portland cement content stuccos, electrical grade (E-glass) for most polymer-modified stuccos, a modified E-glass that is chemically resistant (ECR-glass), and high strength (S-glass). The representative chemical compositions of these four glasses are given in Table 1.

TABLE 1

Glass composition

| | Material, wt % | | | | | | | | |
|---|---|---|---|---|---|---|---|---|---|
| Glass type | Silica | Alumina | Calcium oxide | Magnesia | Boric oxide | Soda | Calcium fluoride | Zirconium Oxide | Total minor oxides |
| E-glass | 54 | 14 | 20.5 | 0.5 | 8 | 1 | 1 | — | 1 |
| A-glass | 72 | 1 | 8 | 4 | — | 14 | — | — | 1 |
| ECR-glass | 61 | 11 | 22 | 3 | — | 0.6 | — | — | 2.4 |
| S-glass | 64 | 25 | — | 10 | — | 0.3 | — | — | 0.7 |
| AR-glass | 62 | 1.8 | 5.6 | — | — | 14.8 | — | 16.7 | 0.1 |

The inherent properties of the four glass fibers having these compositions are given in Table 2.

TABLE 2

Inherent properties of glass fibers

| | Specific | Tensile strength | | Tensile modulus | | Coefficient of thermal expansion, | Dielectric | Liquidus temperature | |
|---|---|---|---|---|---|---|---|---|---|
| | gravity | MPa | Ksi | GPa | $10^6$ psi | $10^{-6}$/K | constant(a) | C. ° | F. ° |
| E-glass | 2.58 | 3450 | 500 | 72.5 | 10.5 | 5.0 | 6.3 | 1065 | 1950 |
| A-glass | 2.50 | 3040 | 440 | 69.0 | 10.0 | 8.6 | 6.9 | 996 | 1825 |
| ECR-glass | 2.62 | 3625 | 525 | 72.5 | 10.5 | 5.0 | 6.5 | 1204 | 2200 |
| S-glass | 2.48 | 4590 | 665 | 86.0 | 12.5 | 5.6 | 5.1 | 1454 | 2650 |

(a)At 20° C. (72° F.) and 1 MHZ. Source: Ref 4

Glass Melting and Forming

The conversion of molten glass in the forehearth into continuous glass fibers is basically an attenuation process. The molten glass flows through a platinum-rhodium alloy bushing with a large number of holes or tips (400 to 8000, in typical production). The bushing is heated electrically, and the heat is controlled very precisely to maintain a constant glass viscosity. The fibers are drawn down and cooled rapidly as they exit the bushing. A sizing is then applied to the surface of the fibers by passing them over an applicator that continually rotates through the sizing bath to maintain a thin film through which the glass filaments pass. After the sizing is applied, the filaments are gathered into a strand before approaching the take-up device. If smaller bundles of filaments (split strands) are required, multiple gathering devices (often called shoes) are used.

The attenuation rate, and therefore the final filament diameter, is controlled by the take-up device. Fiber diameter is also impacted by bushing temperature, glass viscosity, and the pressure head over the bushing. The most widely used take-up device is the forming winder, which employs a rotating collet and a traverse mechanism to distribute the strand in a random manner as the forming package grows in diameter. This facilitates strand removal from the package in subsequent processing steps, such as roving or chopping. The forming packages are dried and transferred to the specific fabrication area for conversion into the finished fiberglass roving, mat, chopped strand, or other product. In recent years, processes have been developed to produce finished roving or chopped products directly during forming, thus leading to the term direct draw roving or direct chopped strand.

Fabrication Process

Once the continuous glass fibers have been produced they must be converted into a suitable form for their intended application. The major finished forms are continuous roving, woven roving, fiberglass mat, chopped strand, and yarns for textile applications. Yarns are used in many applications of this invention.

Fiberglass roving is produced by collecting a bundle of strands into a single large strand, which is wound into a stable, cylindrical package. This is called a multi-end roving process. The process begins by placing a number of oven-dried forming packages into a creel. The ends are then gathered together under tension and collected on a precision roving winder that has constant traverse-to-winding ratio, called the waywind.

Woven roving is produced by weaving fiberglass roving into a fabric form. This yields a coarse product. The course surface is ideal for stucco and adhesive applications, since these materials can bind to the coarse fibers easily. Plain or twill weaves are less rough, thereby being easier to handle without protective gloves, but will absorb stucco and adhesive. They also provide strength in both directions, while a unidirectionally stitched or knitted fabric provides strength primarily in one dimension. Many novel fabrics are currently available, including biaxial, double bias, and triaxial weaves for special applications.

Combinations of fiberglass mat, scrim, chopped fibers and woven or knit filaments or roving can also be used for the preferred reinforcing fabric 101 and lath 30 constructions. The appropriate weights of fiberglass mat (usually chopped-strand mat) and woven roving filaments or loose chopped fibers are either bound together with a chemical binder or mechanically knit, needled, felted or stitched together.

The yarns of the reinforcing fabric 101 and lath 30 of this invention can be made by conventional means. Fine-fiber strands of yarn from the forming operation can be air dried on forming tubes to provide sufficient integrity to undergo a twisting operation. Twist provides additional integrity to yarn before it is subjected to the weaving process, a typical twist consisting of up to one turn per inch. In many instances heavier yarns are needed for the weaving operation. This is normally accomplished by twisting together two or more single strands, followed by a plying operation. Plying essentially involves retwisting the twisted strands in the opposite direction from the original twist. The two types of twist normally used are known as S and Z, which indicate the direction in which the twisting is done. Usually, two or more strands twisted together with an S twist are plied with a Z twist in order to give a balanced yarn. Thus, the yarn properties, such as strength, bundle diameter, and yield, can be manipulated by the twisting and plying operations. Fiberglass yarns are converted to fabric form by conventional weaving operations. Looms of various kinds are used in the industry, but the air jet loom is the most popular.

Zero twist-yarns may also be used. This input can offer the ease of spreading of (twistless) roving with the coverage of fine-filament yarns. The number of filaments per strand used directly affect the porosity and are related to yarn weight as follows: $n=(490\times Tex)/d^2$, where "d" is the individual filament diameter expressed in microns. Thus, if the roving with coarse filaments can be replaced with near zero twist yarn with filaments half the diameter, then the number of filaments increases by a factor of 4 at the same strand Tex.

The major characteristics of the woven embodiments of this invention include its style or weave pattern, fabric count, and the construction of warp yarn and fill yarn. Together, these characteristics determine fabric properties such as drapability and performance in stucco systems. The fabric count identifies the number of warp and fill or weft yarns per inch. Warp yarns run parallel to the machine direction, and weft yarns are perpendicular.

There are basically four weave patterns: plain, basket, twill, and satin. Plain weave is the simplest form, in which one warp yarn interlaces over and under one fill yarn. Basket weave has two or more warp yarns interlacing over and under two or more fill yarns. Twill weave has one or more warp yarns over at least two fill yarns. Satin weave (crowfoot) consists of one warp yarn interfacing over three and under one fill yarn, to give an irregular pattern in the fabric. The eight harness satin weave is a special case, in which one warp yarn interlaces over seven and under one fill yarn to give an irregular pattern. In fabricating a board, the satin weave gives the best conformity to complex contours, such as around corners, followed in descending order by twill, basket, and plain weaves.

Texturizing is a process in which the textile yarn is subjected to an air jet that impinges on its surface to make the yarn "fluffy". The air jet causes the surface filaments to break at random, giving the yarn a bulkier appearance. The extent to which this occurs can be controlled by the velocity of the air jet and the yarn feed rate. An equivalent effect can be produced by electrostatic or mechanical manipulation of the fibers, yarns or roving.

Fabric Design

The fabric pattern, often called the construction, is an x, y coordinate system. The y-axis represents warp yarns and is the long axis of the fabric roll (typically 30 to 150 m, or 100 to 500 ft.). The x-axis is the fill direction, that is, the roll width (typically 910 to 3050 mm, or 36 to 120 in.). Basic fabrics are few in number, but combinations of different types and sizes of yarns with different warp/fill counts allow for hundreds of variations.

Basic fabric structures include those made by woven, non-woven and knit processes. In this invention, one preferred design is a knit structure in which both the x axis strands and the y axis strands are held together with a third strand or knitting yarn. This type of knitting is weft-inserted-warp knitting. If an unshifted tricot stitch is used, the x and y axis strands are the least compressed and, therefore, give the best coverage at a given areal weight. This structure's coverage can be further increased, i.e., further reduction in porosity, by using near-zero-twist-yarn or roving which, naturally, spreads more than tightly twisted yarn. This design can be further improved by assisting the spreading of filaments by mechanical (needling) means, or by high-speed air dispersion of the filaments before or after fabric formation.

The most common weave construction used for everything from cotton shirts to fiberglass stadium canopies is the plain weave. The essential construction requires only four weaving yarns: two warp and two fill. This basic unit is called the pattern repeat. Plain weave, which is the most highly interlaced, is therefore the tightest of the basic fabric designs and most resistant to in-plane shear movement. Basket weave, a variation of plain weave, has warp and fill yarns that are paired: two up and two down. The satin weave represent a family of constructions with a minimum of interlacing. In these, the weft yarns periodically skip, or float, over several warp yarns. The satin weave repeat is x yarns long and the float length is x−1 yarns; that is, there is only one interlacing point per pattern repeat per yarn. The floating yarns that are not being woven into the fabric create considerable looseness or suppleness. The satin weave produces a construction with low resistance to shear distortion and is thus easily molded (draped) over common compound curves. Satin weaves can be produced as standard four-, five-, or eight-harness forms. As the number of harnesses increases, so do the float lengths and the degree of looseness making the fabric more difficult to control during handling operations. Textile fabrics generally exhibit greater tensile strength in plain weaves, but greater tear strength in satin weaves. The higher the yarn interlacing (for a given-size yarn), the fewer the number of yarns that can be woven per unit length. The necessary separation between yarns reduces the number that can be packed together. This is the reason for the higher yarn count (yarns/in.) that is possible in unidirectional material and its better physical properties.

A plain weave having glass weft and warp yarns or roving, in a weave construction is known as locking leno. The gripping action of the intertwining leno yarns anchors or locks the open selvage edges produced on rapier looms. The leno weave helps prevent selvage unraveling during subsequent handling operations. However, it is also valuable where a very open (but stable) weave is desired, such as in exterior finishing systems, such as EIFS and stucco systems.

Figure 2:
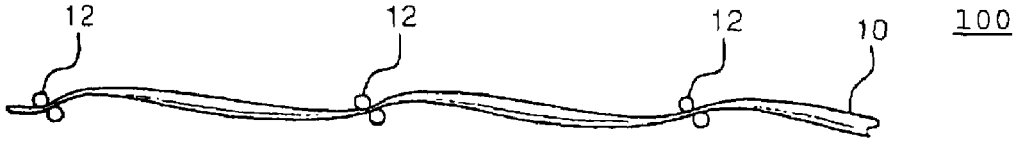
FIG. 2 is a front plan view of the fabric structure of FIG. 1.

The preferred "leno weave" fabric 100 of this invention consists of weft yarns 10 and warp yarns 12. The weft yarns 10 are oriented in the cross-machine direction and the warp yarns 12 are oriented in the machine direction 10. As shown in FIGS. 1 and 2, the well yarns 10 and warp yarns 12 are twisted around one another at regular intervals and are initially locked in place. Preferably, the spacing between yarns is fairly open with hole sizes ranging in area from 0.02 square inches to more than 4.0 square inches (0.5-102 $mm^2$). Such an open weave allows trowel- or sprayed-applied stucco to easily penetrate, or otherwise "key" into the lath. The leno weave 100, once converted into a "thickened" fabric 101, also provides support for the weight of the wet stucco, such as a from about ⅜ to about ¾ inch (about to 9.53 about 19.05 mm) application of base coat, until it sets.

Figure 3:
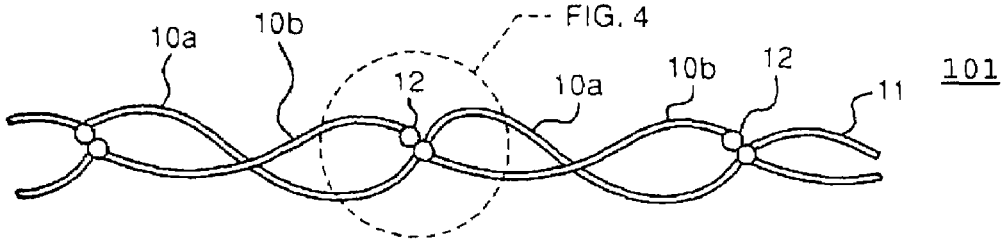
FIG. 3 is a front plan view of the fabric structure of FIG. 1 after manipulation of the fibers to increase fabric thickness.

One of the important features of the present invention is demonstrated in FIG. 3 in which alternate weft yarns 10A and 10B of thickened fabric 101 are shown assuming a generally sinusoidal profile when viewed in the plain of the fabric, and more preferably, the weft yarns alternate between sinusoidal profiles having at least two different orientations represented by weft yarns 10A and 10B, for example. Metal lath or metal wire mesh for stucco systems typically must be at least 0.125 inches (3.175 mm) thick, preferably greater than about 10 mm in order to meet building codes for metal lath (ASTM C847-95), for welded wire lath (ASTM C933-96A) and for woven wire plaster base (ASTM C 1032-296). Experience has proven that such thicknesses are rarely achievable in a cost effective way utilizing glass yarns employing the normal means of fabric formation. By exploiting the nature of specific weave constructions, such as a leno weave, and by coating and drying the product on a tenter frame, whereby the width of the fabric can be controlled, the preferred thickened fabric 101 or lath structure 30 can be produced in a controlled and repeatable way.

In a first embodiment of producing a thickened fabric 101 or lath 30 of this invention, the warp yarns of the leno weave fabric 100 are subjected to a tensile force. The warp yarns 12 then begin to untwist themselves, creating a torque effect on the well yarns 10A and 10B, for example. As each warp yarn 12 untwists, the combined torque effect creates a weft yarn 10A or 10B that assumes a sinusoidal profile when viewed in the plane of the fabric. See FIG. 3. The thickness of the now thickened fabric 101 as measured from the high point and low point of the sinusoidal profiles of well yarns 10A and 10B ("t") thus increases with a slight loss in the width of the original leno weave fabric 100.

Figure 4:
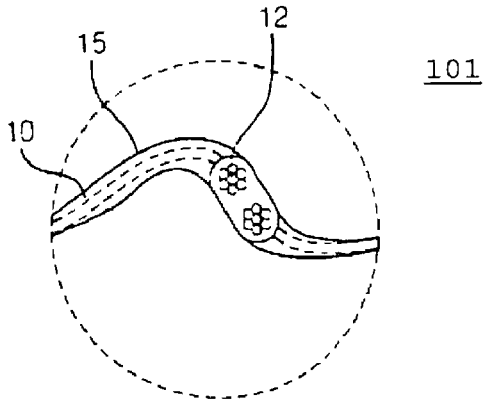
FIG. 4 is a magnified view of a cross over point for the manipulated fabric structure of FIG. 3.
Figure 5:
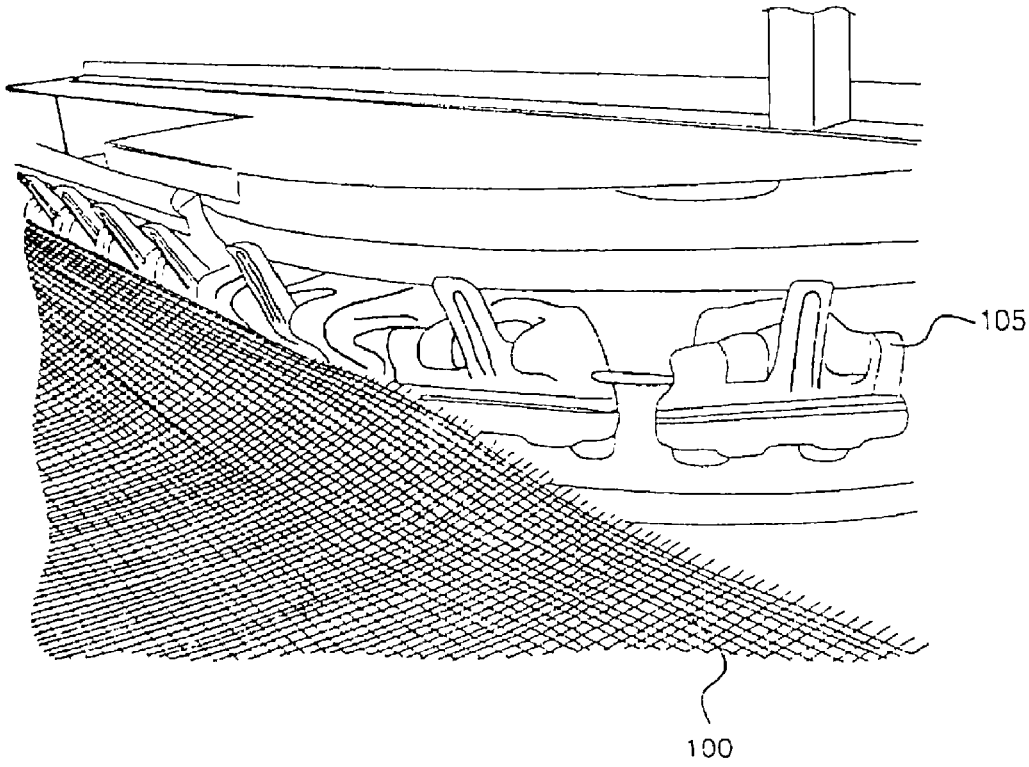
FIG. 5 is a front perspective view of a preferred manufacturing embodiment in which the fabric of FIG. 1 is held by clip chains of a tenter frame.

It has been determined that this "thickness increase" for the fabric 101 can be fixed by a resinous binder or coating 15, as shown in the exploded view FIG. 4. The resinous coating is dried on a preferred tenter frame 105 equipped with clips, as shown in FIG. 5. The tenter frame 105 functions to apply the necessary tension to the warp yarns of the fabric to induce the torquing effect. The clips hold the edges of the fabric as it runs through the coating line and drying oven (not shown), and are adjustable to add or subtract fabric width as needed. Applying high tension to the warp yarns, while allowing the width of the fabric 100 to slightly decrease by the use of clips can increase the thickness of the fabric 100 via the torque effect on the weft yarns created by the tensile force applied to the warp yarns 12. Although tenter frames equipped with clips have been useful in practicing this invention, this invention is not so limited. "Clipless" drying systems can be used with some greater variation in the weft and thickness of the fabric. It is also believed that the magnitude of the thickness can be further enhanced by other means. One such method is to create a fabric with an "unbalanced" construction, such that the combined weight of the warp yarns is greater than the combined weight of the well yarns. The ability of the well yarns to resist deformation due to torque is thus reduced. Another way to accomplish greater thickness in the substrates of this invention is to use a heavier warp yarn, but less of them in the warp direction than in the weft direction. This results in a greater amount of tension per warp yarn and a wider span of well yarn to be acted upon. The torque effect will increase with its accompanying increase in fabric thickness.

The design of glass fabrics suitable for this invention begins with only a few fabric parameters: type of fiber, type of yarn, weave style, yarn count, and areal weight. Fiber finish is also important because it helps lubricate and protect the fiber as it is exposed to the sometimes harsh weaving operation. The quality of the woven fabric is often determined by the type and quality of the fiber finish. The finish of choice, however, is usually dictated by end-use and resin chemistry, and can consist of resinous materials, such as epoxy, styrene-butadiene, polyvinyl chloride, polyvinylidene chloride, acrylics and the like.

The following fabric styles and categories are useful in the practice of this invention:

| Fabric | Areal wt. grams/m$^2$ | oz/yd$^2$ |
|---|---|---|
| Light weight | 102-340 | 3-10 |
| Intermediate weight | 340-678 | 10-20 |
| Heavy weight | 508-3052 | 15-90 |

| Fabric | Thickness μm | mil |
|---|---|---|
| Light weight | 25-125 | 1-5 |
| Intermediate weight | 125-250 | 5-10 |
| Heavy weight | 250-500 | 10-20 |

It has been determined that fabrics having an areal weight of about 102-3052 grams/m$^2$ and thicknesses of about 0.025-0.25 inches are most preferred.

Increasing the thickness of the fabric 100 of this invention, without significantly adding to the cost can provide a reinforced product, whether it be an EIFS 200 or polymer composite, with good longitudinal strength/stiffness values, as well as transverse (fill direction) toughness and impact resistance.

It is also possible to use three-directional weaving, but interesting modifications are even possible for two-directional fabric. The loom has the capability of weaving an endless helix using different warp and fiber fill. Alternatively, a glass textile roving warp or weft, such as E-glass yarn and olefin warp weft, such as polyethylene or polystyrene fiber, can be used. Alternatively, blends such as Twintex® glass-polyolefin blends produced by Saint-Gobain S.A., Paris, France, or individual multiple layers of polymers, elastomerics, rayon, polyester and glass filaments can be used as roving or yarn for the facing material, or as additional bonded or sewn layers of woven, knitted felt or non-woven layers.

A typical binder/glass fiber loading is about 3-30 wt %. Such binders may or may not be a barrier coating, and will enable the exterior finishing materials to easily pass through the lath during a stucco system or EIFS construction. These binders also may or may not completely coat the exterior facing fibers of the lath. Various binders are appropriate for this purpose, such as, for example, phenolic binders, ureaformaldehyde resin, or ureaformaldehyde resin modified with acrylic, styrene acrylic, with or without carboxylated polymers as part of the molecule, or as a separate additive. Additionally, these binders can be provided with additives, such as UV and mold inhibitors, fire retardants, etc. Carboxylated polymer additions to the binder resin can promote greater affinity to set gypsum, or to Portland cement-based mortars, for example, but are less subjected to blocking than resins without such additions. One particularly desirable binder resin composition is a 70 wt % ureaformaldehyde resin-30 wt % styrene acrylic latex or an acrylic latex mixture, with a carboxylated polymer addition.

The fabric 101 or lath 30 of this invention can be further treated or coated with a resinous coating 15 prior to use, to help fix the weft fibers 10*a* and 10*b* in a preferred sinusoidal pattern, as shown in FIGS. 3 and 4. Resinous coatings 15 are distinguished from the sizing or binder used to bond the fibers together to form the individual layers, as described above. Coatings 15 can include those described in U.S. Pat. No. 4,640,864, which is hereby incorporated herein by reference, and are preferably alkali-resistant, water-resistant and/or fire-retardant in nature, or include additives for promoting said properties. They are preferably applied during the manufacture of the fabric 101 or lath 30.

The coating 15 applied to the fabric 101, as shown in FIG. 4, of this invention preferably coats a portion of the fibers and binds the yarns 10 and 12 together. Alternatively, the coating 15 can increase or decrease the wetting angle of the stucco slurry to reduce penetration into the yarns or increase adhesion. The coating 15 can further contain a UV stabilizer, mold retardant, water repellant, a flame retardant and/or other optional ingredients, such as dispersants, catalysts, fillers and the like. Preferably, the coating 15 is in liquid form and the fabric 101 is led through the liquid under tension, such as by a tenter frame 105, or the liquid is sprayed (with or without a water spray precursor) on one or both sides of the fabric 101. Thereafter, the fabric 101 or lath 30 may be squeezed and dried.

Various methods of applying the liquid may be used, including dip-coaters, doctor blade devices, roll coaters and the like. One preferred method of treating the fabric 101 with the resinous coatings 15 of this invention is to have a lower portion of one roll partially submerged in a trough of the liquid resinous composition and the fabric 101 pressed against the upper portion of the same roller so that an amount of the resinous composition is transferred to the fabric 101. The second roller above the first roller controls the movement of the fabric 101 and the uniformity of the amount of resinous coating 15 disposed thereon. Thereafter, the coated fabric 101 is led in a preferred method to steam cans to expedite drying.

It is preferred to pass the coated fabric over steam cans at about 250-450° F. (100-200° C.) which drives the water off, if a latex is used, and additionally may cause some flow of the liquid resinous material to further fill interstices between fibers, as well as coat further and more uniformly fibers within the fabric 101. The coating preferably covers about 50-80% of the surface area targeted, more preferably about 80-99% of said area.

The preferred resinous coatings 15 of this invention can contain a resinous mixture containing one or more resins. The resin can contain solid particles or fibers which coalesce or melt to form a continuous or semi-continuous coating. The coating can be applied in various thicknesses, such as for example, to sufficiently cover the fibrous constituents of the fabric 101 so that no fibers protrude from the coating 15, or to such a degree that some of the fibers protrude from the coating 15.

The coating 15 of this invention can be formed substantially by the water-resistant resin, but good results can also be achieved by forming the coating or saturant from a mixture of resin and fillers, such as silicates, silica, gypsum, titanium dioxide and calcium carbonate. The coating 15 can be applied in latex or curable thermosetting form. Acceptable resins include styrene/butadiene and styrene/acrylic copolymer, acrylics, flame retardant acrylics or brominated monomer additions to acrylic, such as Pyropoly AC2001, poly(vinyl acetates), poly(vinyl alcohols), vinylidene chloride, siloxane, and polyvinylchloride such as Vycar® 578. In addition, fire retardants, such as bromated phosphorous complex, halogenated paraffin, colloidal antimony pentoxide, borax, unexpanded vermiculite, clay, colloidal silica and colloidal aluminum can be added to the resinous coating or saturant. Furthermore, water resistant additives can be added, such as paraffin, and combinations of paraffin and ammonium salt, fluorochemicals designed to impart alcohol and water repellency, such as FC-824 from 3M Co., organohydrogenpolysiloxanes, silicone oil, wax-asphalt emulsions and poly(vinyl alcohol) with or without a minor amount a minor amount of poly(vinyl acetate). Finally, the coatings 15 can include pigment, such as kaolin clay, or lamp black thickeners.

Example A

A trial was undertaken to prove the efficacy of inducing significant thickness increases (in the "Z" plane) into an open, leno weave fabric of unbalanced construction. It was hoped that such a fabric would prove useful in replacing chicken wire or metal lath in exterior stucco building applications.

This trial tested a theory for leno wave products that when the collective weight of warp yarns significantly outweighs that of the weft yarns, a noticeable torque effect is induced in the weft yarns when under tension on the finishing machines. The torque effect causes the weft yarns to deform in a sinusoidal fashion across the width of the web, and thus the fabric thickness ("t") increases.

Calculations have shown that a fabric based on existing fabric style No. 0061 by Saint-Gobain Technical Fabrics, St. Catharines, Ontario, Canada, will serve as a useful starting point for development in that it has approximately the right construction and cost. The 0061 fabric was modified to unbalance the construction by replacing the 735 tex weft yarn with a 275 tex yarn. This both reduces the fabric cost and helped ensure that the torque effect would be observed. A stiff, inexpensive SBR (styrene-butadiene rubber) latex was selected (style 285) for the coating as it has the advantage of low cost; alkali resistance; the excellent toughness needed to bond the open fabric; and rigidity to keep the fabric from sloughing when stucco is applied. Our Frame D, shown partially in FIG. 5, was selected as the finishing machine for two reasons: it is the only one capable of coating two 1.2 meter panels side-by-side; and the clips of the tenter frame 105 would serve to control the width of the fabric as the torque effect takes place. Without the clips, it is expected that the width of the fabric would be difficult to control on the finishing line.

It was found that the thickness of the fabric could be increased a multiple of the thickness that the same fabric had without the torque effect. The observed increase was a 2.7 times increase, 1.46 mm (0.057 inches) versus an original 0.54 mm (0.021 inches). This was accomplished by applying the highest amount of tension possible to the fabric on Frame D, and then slowly decreasing the width of the clips. The fabric width decreased from 2465 mm to 2380 mm (about 3.4%), which is a loss of 85 mm (3.3 inches). The fabric was not unduly distorted by the process, and with some fine-tuning the quality should be acceptable. Two rolls of 45.7 meter length and two of 30 meter length of the stucco mesh were produced.

| Details of Trial | |
|---|---|
| Machine: | frame D |
| Line Speed: | 25 meters/min |
| Oven Temp: | 185/185° C. |
| Winder: | center wind |
| Let-off pressure: | 140 psig |
| Front output press.: | 8 psig |
| Tension: | 15 |
| Clip spacing: | 93 inches |
| Fabric Analysis | |
| Finished Width of one panel: | 1190 mm (1202 mm including fringe edge). |
| Yarn Count: | 20.64 × 10.0 ends/picks per 10 cm |
| Coated Fabric Weight: | 113.4 grams/m2 |
| Coating Add-on: | 31.9% |
| Thickness: | 1.46 mm (0.058 inches) |

The preferred lath of this invention is ideally suited for replacing metal lath or wire mesh (chicken wire) under the base coat of stucco in the stucco system. It can also be used as a substitute for a drainage mat or as a substitute for the reinforcing fiberglass mesh often inserted into the base coat of EIFS and DEFS systems.

Figure 6:
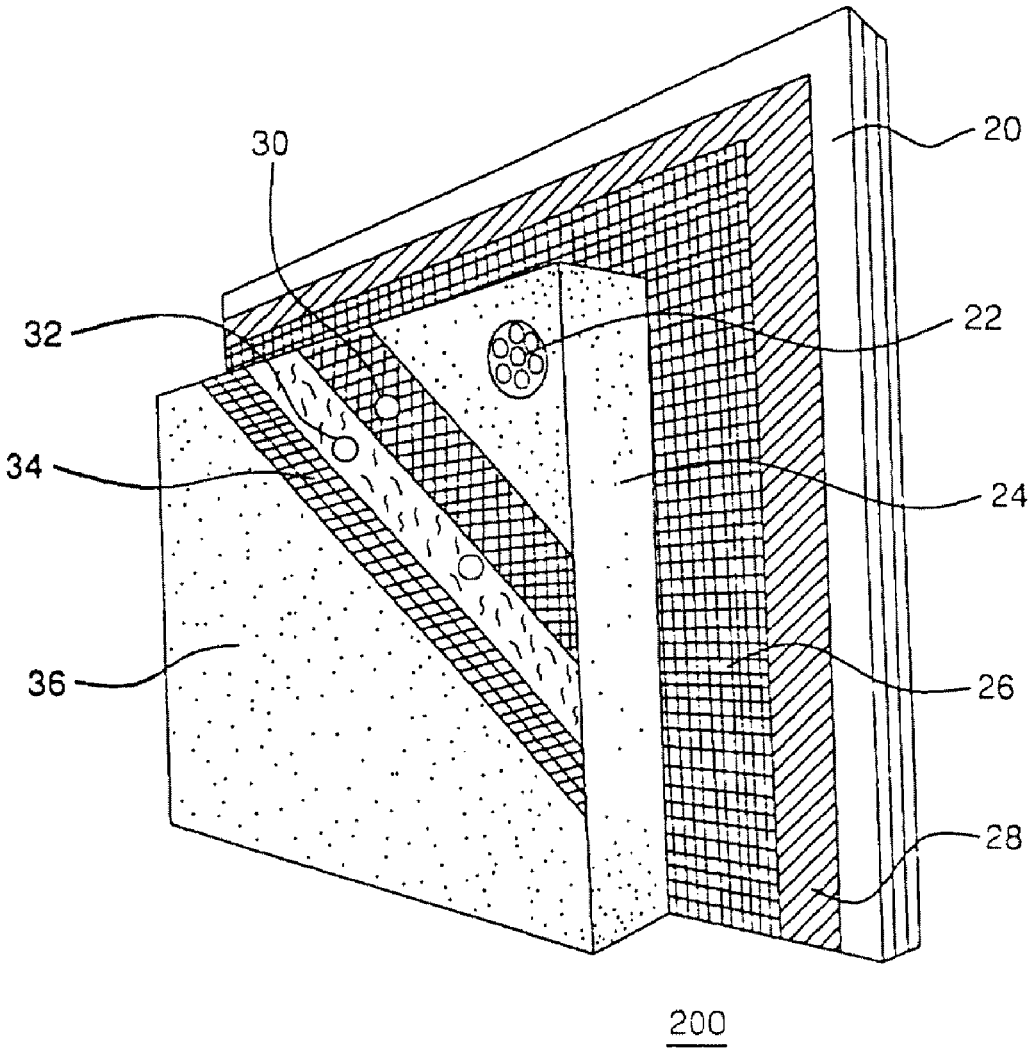
FIG. 6 is a front perspective, partial peal-away, view of a preferred EIFS incorporating an enhanced thickness reinforcing mesh.

By way of example, an EIFS 200 is shown is FIG. 6. It includes a substrate 20 which can be a glass-faced gypsum board, such as DENS-GLAS® board from Georgia Pacific, plywood sheathing, or OSB. Disposed over the substrate 20 is may be a secondary weather barrier 28, such as a polymeric barrier sheet (eg—Tyvek® sheet), building paper, or tar paper. Applied over the secondary weather barrier 28 is an optional commercially available drainage mat 26. Without limitation, in one embodiment, drainage may 26 comprises a flexible, thermally pre-formed polyamide mat. The drainage mat 26 is used to create a drainage plane for the EIFS. Disposed over the drainage mat 26 in the EIFS 200 of FIG. 6 is an insulation board 24 which is affixed to the substrate 20 by a fastener and washer 22, or optionally, an adhesive. Preferably, insulation board 24 is a polystyrene insulation board. If an adhesive is used, silicone-based or acrylic-based adhesives are preferred.

The preferred enhanced thickness reinforcing mesh 30 of this invention is applied over the polystyrene insulation board 24 and is affixed the substrate either with staples, screws or rooting nails. Applied over the enhanced thickness reinforcing mesh 30 is at least one layer of an EIFS base coat 32. Alternatively, the EIFS base coat 32 is applied over the insulation board 24 and the enhanced thickness reinforcing mesh is substantially embedded in the base coat 32. At least one layer of an EIFS finish coat 36 is applied over the enhanced thickness reinforcing mesh 30 and base coat 32.

A building wall structure comprising a frame, a substrate and an exterior finishing system including the enhanced thickness lath is also provided. The exterior finishing system may include a stucco systems, EIFS and the like. The building wall is generally constructed of a frame having exterior surfaces, a substrate attached to the exterior surfaces of substrate, and an exterior finishing system including the enhanced thickness lath applied over the substrate.

In one embodiment, the wall is of a typical 2×4 frame construction, although other construction techniques and configurations are equally suitable. The frame typically includes a plurality of studs, which are members of wood or steel having, in one preferred embodiment, nominal dimensions of 2"×4". The studs are vertically oriented and are parallel and spaced apart a distance of typically 16" or 24", although these dimensions and parameters are subject to change in response to new building codes and additional advances in the relevant art. The studs are each typically fixedly attached at an upper end to a plate, with the plate typically being a member of similar dimension to the studs and oriented horizontally such that multiple vertical studs in a wall are fixedly attached to a single plate. The studs are usually fixedly attached to plate by means of mechanical fasteners such as nails and/or screws. This structure is referred to in the relevant art as a "framed" wall.

The frame additionally contains an interior surfaces which face toward the living area and exterior surfaces which face toward the outside environment. A layer of substrate material is typically fixedly attached to exterior surfaces of the frame. The substrate is typically a sheet of material such as plywood sheathing or OSB, or any of a variety of other materials. While the installation of sheathing might be optional in some circumstances, such circumstances will typically be dictated by applicable building codes. The sheathing is typically attached to the exterior surface by mechanical fasteners such as screws, nails, staples, and the like, and may likewise be fastened with materials such as adhesives, all of which are well known in the relevant art. The exterior finishing system including the enhanced thickness fabric is applied over the substrate.

With regard to stucco systems, the framed wall is constructed. A substrate material is attached to the exterior surface of the frame. An insulation board is optionally affixed over the substrate. For stucco systems having an insulation affixed over the substrate, the enhanced thickness lath is affixed over the insulation board. At least one layer of exterior finishing material comprising stucco is applied over the lath for form an exterior finishing system. It should be noted that the insulation is board is optional and, when insulation is not present, the lath is affixed to the substrate material. Thereafter, at least one layer of exterior finishing materials comprising stucco is applied over the lath. In one embodiment, a secondary weather barrier may be applied over the substrate prior to attaching the lath or optional insulation board to provide additional protection from environmental elements.

Figure 7:
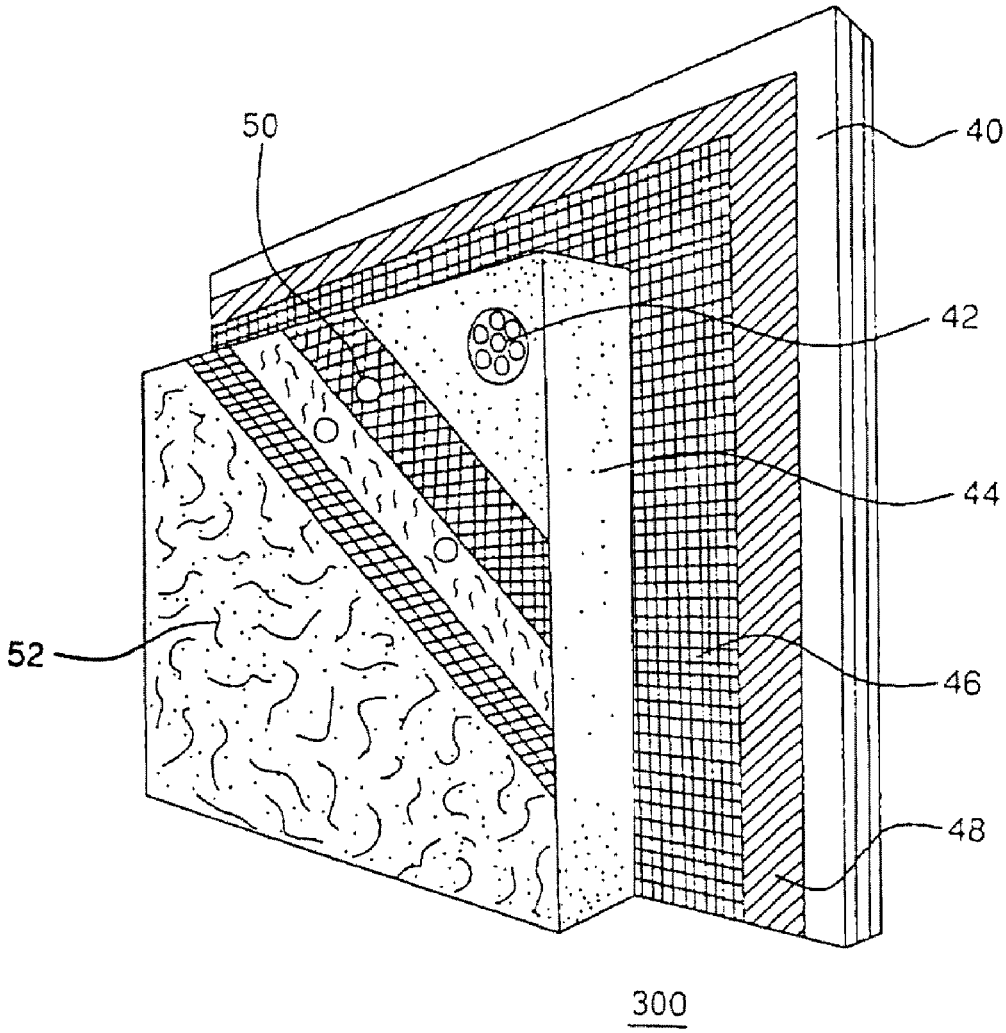
FIG. 7 is a front perspective, partial peal-away view of a preferred stucco system incorporating an enhanced thickness lath.

By way of example, FIG. 7 shows an stucco system 300 incorporating the enhanced thickness lath 50. Disposed over substrate 40 may be a secondary weather barrier 48, such as a polymeric barrier sheet (eg—Tyvek® sheet), building paper, or tar paper. Applied over the secondary weather barrier 48 is an optional commercially available polymeric drainage mat 46. In one embodiment, the drainage mat 46 comprises a flexible, thermally pre-formed polyamide mat. The drainage mat 46 is used to create a drainage plane for the stucco system. Disposed over the drainage mat 46 in the stucco system 300 of FIG. 7 is an optional insulation board 44, for example, a polystyrene insulation board. Optional insulation board 44 is affixed to the substrate 40 by an appropriate fastener 42, or optionally, an adhesive. If an adhesive is used, silicone-based or acrylic-based adhesives are preferred. The preferred lath 50 of this invention is applied over the polystyrene insulation board 44 and is affixed the thereto either with staples, screws or roofing nails. Alternatively, the lath 50 can be applied over the secondary weather barrier 48, or directly to the substrate surface 40. Applied over the lath 50 is a stucco base coat 52 which can be applied in scratch and brown layers, for example, with or without a reinforcing fiberglass fibers. Finally, a stucco finish coat is applied over the stucco base coat to provide the final texture and color.

With regard to EIFS, the framed wall is first constructed. A substrate material is attached to the exterior surface of the frame. An insulation board is affixed over the substrate. A base coat is then applied over the exterior surface of the substrate layer. The enhanced thickness lath is affixed over and substantially embedded into the base coat layer. At least one layer of a finish coat is applied over the base coat and lath. In one embodiment, a secondary weather barrier may be applied over the substrate prior to attaching the insulation board to provide additional protection from environmental elements.

From the foregoing, it can be realized that this invention provides corrosion-resistant lath for exterior finishing systems, including stucco systems and exterior insulation and finish systems, and methods of making an exterior finishing system and a building wall including an exterior finish system. The corrosion-resistant lath is strong enough to support an applied exterior finishing materials, including a stucco finish and provides sufficient furring capability such as to fur the body of the lath a minimum of about ⅛ inches (3.18 mm) from the substrate. The preferred corrosion-resistant laths of this invention may include an AR-glass coated to fix the position of the weft and warp yarns, or another open-woven fabric of non-metallic fibers, for example, E-glass fibers, coated with an alkaline-resistant polymeric coating which both protects the preferred glass fibers of the lath, and also fixes the weft yarns in an undulated condition. Although various embodiments have been illustrated, this was for the purpose of describing, and not limiting, the invention. Various modifications, which will become apparent to one skilled in the art, are within the scope of the invention described in the attached claims.

We claim:

1. A building wall comprising:

a building wall substrate;

a corrosion-resistant woven lath attached to said substrate, said lath comprising warp and weft yarns comprising non-metallic fibers, wherein a portion of said warp yarns are heavier than a portion of said weft yarns and said warp yarns are fewer in number than said weft yarns, and wherein at least a portion of said weft yarns are undulated when viewed in the plane of the lath; and a stucco matrix applied to said lath.

2. A building wall comprising:

a building wall substrate;

an insulation board attached to the substrate;

a base coat applied to the insulation board;

a reinforcing mesh comprising warp and weft yarns comprising non-metallic fibers, wherein a portion of said warp yarns are heavier than a portion of said weft yarns and said warp yarns are fewer in number than said weft yarns and wherein at least a portion of said weft yarns are undulated when viewed in the plane of the mesh; and a finish coat applied to said reinforcing mesh, wherein the reinforcing mesh is substantially embedded within the base coat and the finish coat.

3. The building wall of claim 1, wherein the non-metallic fibers are selected from the group consisting of polymeric fibers, glass fibers, and combinations thereof.

4. The building wall of claim 3, wherein said non-metallic fibers comprise glass fibers.

5. The building wall of claim 4, wherein said glass fibers are selected from the group consisting of E-glass fibers, A-glass fibers, ECR-glass fibers, S-glass fibers, AR-glass fibers and combinations thereof.

6. The building wall of claim 5, wherein said glass fiber comprise AR-glass fibers.

7. The building wall of claim 6, wherein said fabric comprises a leno weave.

8. The building wall of claim 7, wherein said weft yarns are fixed in said undulated condition when viewed in the plane of the lath by a polymeric coating.

9. The building wall of claim 8, wherein at least a portion of said weft yarns are fixed in a substantially sinusoidal pattern when view in the plane of the lath.

10. The building wall of claim 8, wherein said polymeric coating comprises an alkaline resistant coating.

11. The building wall of claim 2, wherein the non-metallic fibers are selected from the group consisting of polymeric fibers, glass fibers, and combinations thereof.

12. The building wall of claim 11, wherein said non-metallic fibers comprise glass fibers.

13. The building wall of claim 12, wherein said glass fibers are selected from the group consisting of E-glass fibers, A-glass fibers, ECR-glass fibers, S-glass fibers, AR-glass fibers and combinations thereof.

14. The building wall of claim 13, wherein said glass fiber comprise AR-glass fibers.

15. The building wall of claim 14, wherein said fabric comprises a leno weave.

16. The building wall of claim 15, wherein said weft yarns are fixed in said undulated condition when viewed in the plane of the lath by a polymeric coating.

17. The building wall of claim 16, wherein at least a portion of said weft yarns are fixed in a substantially sinusoidal pattern when view in the plane of the lath.

18. The building wall of claim 16, wherein said polymeric coating comprises an alkaline resistant coating.

* * * * *